United States Patent [19]

Rusin

[11] Patent Number: 4,887,866

[45] Date of Patent: Dec. 19, 1989

[54] ADJUSTABLE ARMREST

[75] Inventor: Mark M. Rusin, Napa, Calif.

[73] Assignee: Dexta Corporation, Napa, Calif.

[21] Appl. No.: 119,671

[22] Filed: Nov. 12, 1987

[51] Int. Cl.[4] ..... A47C 7/54

[52] U.S. Cl. ..... 297/421; 297/360; 297/411; 297/466

[58] Field of Search ..... 297/359, 360, 411, 417, 297/421

[56] References Cited

U.S. PATENT DOCUMENTS

| | | | |
|---|---|---|---|
| Re. 19,721 | 10/1935 | Genung | 297/417 |
| 352,773 | 11/1886 | Newell | 297/360 X |
| 398,693 | 2/1889 | Bittle | 297/360 |
| 434,515 | 8/1890 | Lee | 297/360 |
| 683,032 | 9/1901 | Franklin | 297/360 |
| 3,038,174 | 6/1962 | Brown et al. | 297/359 X |
| 4,277,102 | 7/1981 | Aaras et al. | 297/417 X |

FOREIGN PATENT DOCUMENTS

| | | | |
|---|---|---|---|
| 388040 | 11/1922 | Fed. Rep. of Germany | 297/411 |
| 2068719 | 8/1981 | United Kingdom | 297/411 |

*Primary Examiner*—Peter R. Brown

*Attorney, Agent, or Firm*—Charles H. Schwartz; Ellsworth R. Roston

[57] ABSTRACT

An adjustable armrest or humeral junture support for use with a chair having a seat and a reclining back. The armrest includes a first rail member attached to the side of the chair back, and a second rail member attached to the side of chair seat. Also, a first sliding member is coupled to the first rail member for sliding along the first rail member and with a locking structure for locking the first sliding member along the first rail member. A second sliding member is coupled to the second rail member for sliding along the second rail member and with a locking structure for locking the second sliding member along the second rail member. An armrest is located adjacent the side of the chair and has a front attachment portion and a back attachment portion and has the back attachment portion of the armrest pivotably attached to the first sliding member for rotational movement about the first sliding member. A pivot link has one end pivotably attached to the front attachment portion and has the other end pivotably attached to the second sliding member for rotational movement about the second sliding member and armrest.

7 Claims, 3 Drawing Sheets

FIG. 1
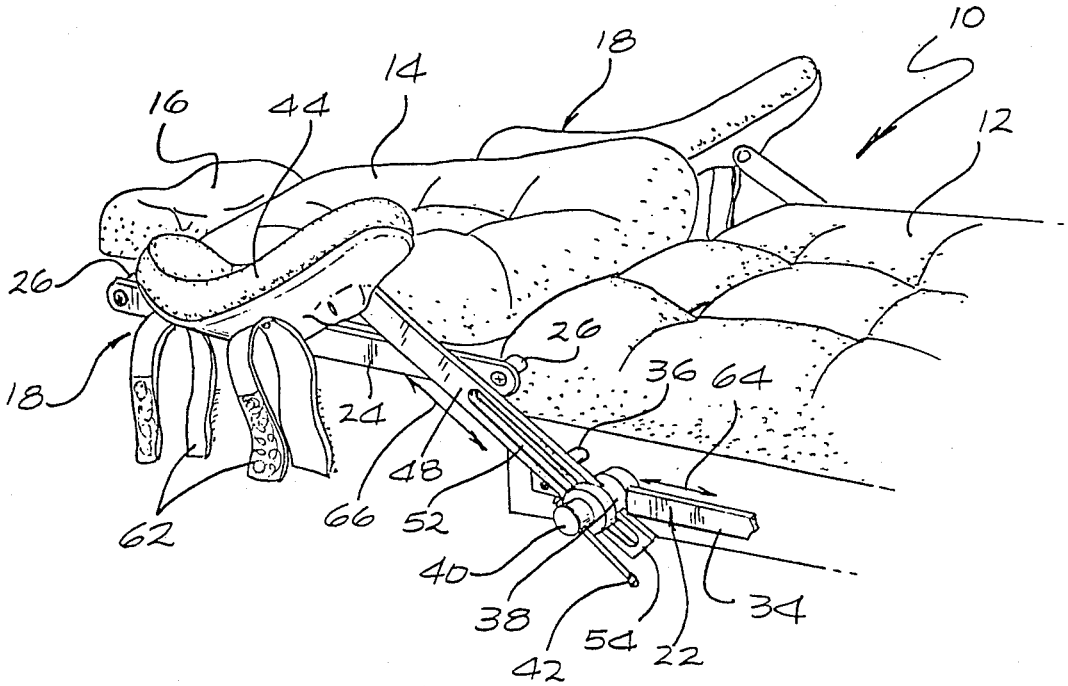
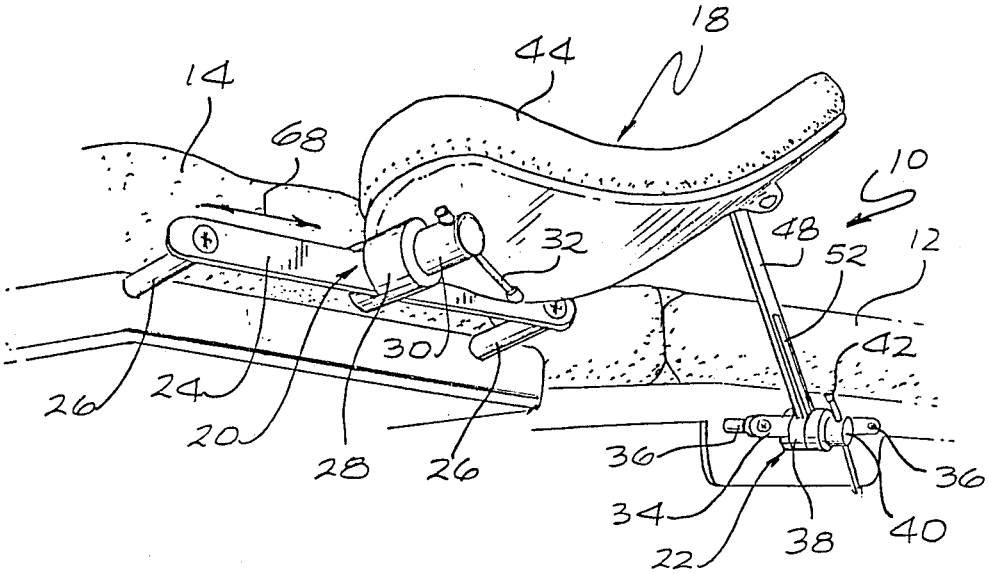
FIG. 2

ADJUSTABLE ARMREST

BACKGROUND OF THE INVENTION

1. Field of the Invention

The present invention relates to an adjustable armrest or humeral juncture support. Specifically, the adjustable support of the present invention provides for the movement of the support to a plurality of positions and with these positions being adjustable whether the chair to which the support is attached is in either an upright or reclining position. This type of adjustable support is, therefore, extremely useful for either medical or dental purposes.

2. DESCRIPTION OF THE PRIOR ART

When a patient is sitting or reclining in a chair to undergo either a dental or medical procedure, it is very important that the patients of different sizes be fully comfortable, both in the sitting and reclining positions. It is also important that the chair provide the proper support for the arms and in particular the humeral juncture which is the upper arm and joints. In the past, such chairs have provided for adjustments for the chair between upright and reclining positions and have also provided some limited adjustment for the armrests.

In addition to the provision of the dental or medical procedure while the patient is in the chair, there are also occasions when either an anesthetic or other fluids are to be administered intravenously into the arm of the patient. It is, therefore, desirable that the patient's arm be in a comfortable and convenient position and be somewhat immobilized during the administration of the fluid. Again, the prior art devices have not provided for sufficient degrees of adjustment to accommodate the different positions for the patient and to accommodate patients of different sizes.

It is, therefore, an object of the present invention to provide for an adjustable armrest support which includes a structural arrangement of parts for moving the armrest to a wide variety of different positions which are desirable and accommodating to patients of different sizes and with the patient located in either an upright or reclining position or positions in-between.

SUMMARY OF THE PRESENT INVENTION

The adjustable armrest or humeral juncture support of the present invention may include a first slide mechanism formed by a rail and slide member attached to the side of the chair back and a second slide mechanism formed by a rail and slide member attached to the side of the seat. An armrest support is pivotally attached at a back portion of the armrest to the first slide member and is attached through a pivot link at a front portion of the armrest to the second slide member. The pivot link also includes a slide adjustment to lengthen or shorten the link.

The above arrangement of parts for the adjustable armrest of the present invention allows the armrest to be adjusted to virtually all positions including height, angle and fore and aft positions relative to the chair whether the chair is in an upright or an inclined position or in some position in-between. In this way, when the patient is sitting in the chair in an upright position, the adjustable armrest may be easily and quickly adjusted to accommodate patients of different sizes so that the arms of the patient are comfortably resting while the patient is undergoing the dental or medical procedure.

Additionally, if the chair is placed in an reclined position and with the patient lying flat, the armrest may be easily and quickly adjusted to again provide a comfortable resting position for the arm of the patient and may be adjusted to provide for a desirable position for the arm while the patient is receiving an intravenous fluid such as an anesthetic. The armrest may also incorporate restraining members to keep the arm of the patient immobile during such procedures.

For some purposes such as medical examination chairs and dental chairs it is not always necessary to provide for a sliding adjustment along the back of the chair. A fixed pivot point may be sufficient but it is important that this pivot point be located in an upper position so as to provide the proper support for the upper arm. The present invention contemplates this fixed pivot point being located near the shoulder joint for the arm.

BRIEF DESCRIPTION OF THE DRAWINGS

A clearer understanding of the present invention will be had with reference to the following description and drawings wherein.

FIG. 1 illustrates a front side perspective view of the adjustable armrest of the present invention attached to a chair in a reclining position;

FIG. 2 illustrates a rear side perspective view of the armrest of the present invention;

DETAILED DESCRIPTION OF THE PREFERRED EMBODIMENT

Figure 3:
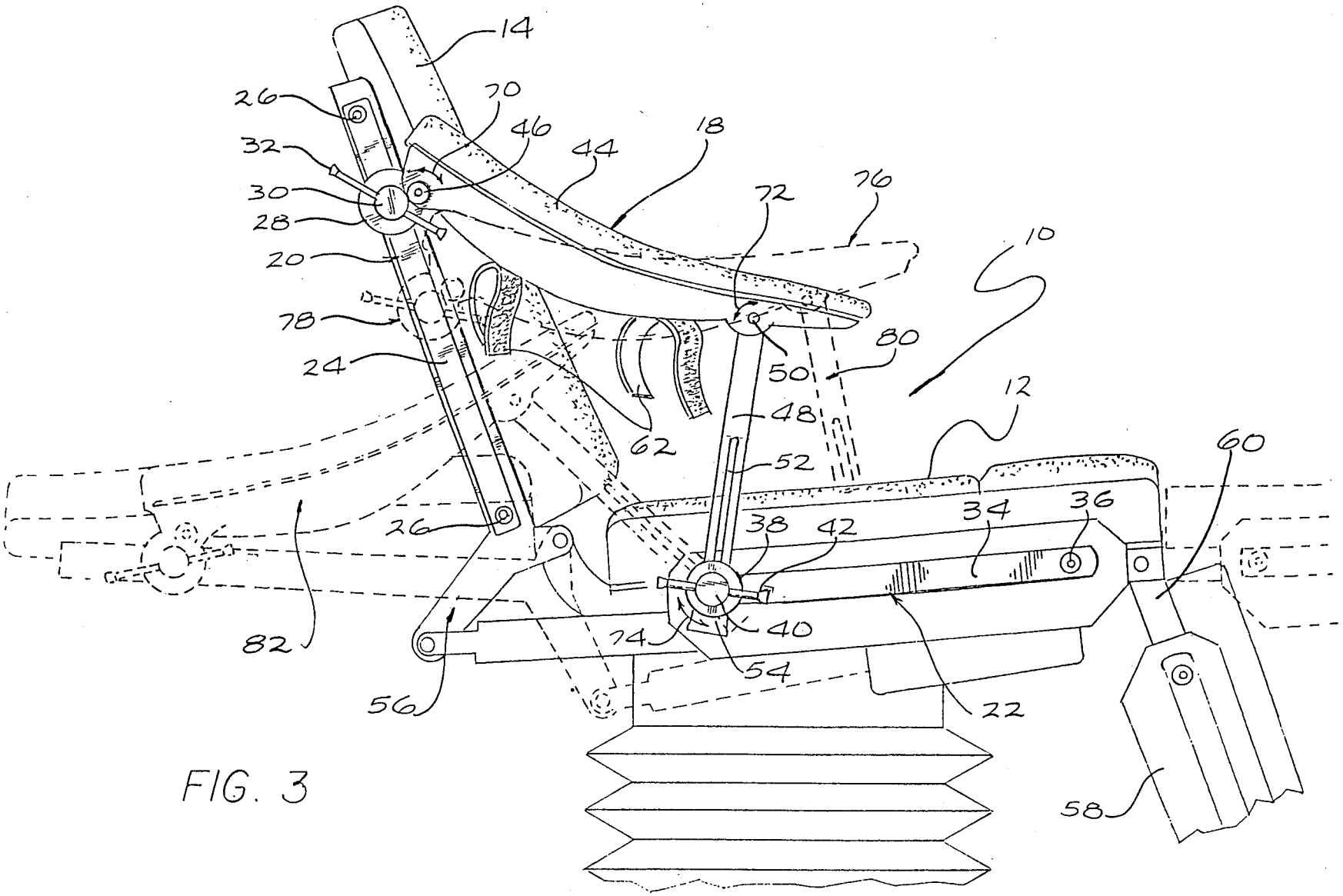
FIG. 3 is a side elevational view showing the armrest in different positions with the chair back in either the upright or reclining position.

As can be seen in the drawings, a seat 10 includes a seat portion 12 and a back portion 14. As shown in FIG. 1, a headrest 16 may also be included to extend from the back portion 14. A pair of armrest assemblies 18 or humeral juncture supports are also shown in FIG. 1, but for purposes of illustration, only the right-hand armrest assembly will be described. It is to be appreciated that the left-hand armrest is substantially identical and merely a mirror image of the right-hand armrest assembly.

Figure 4:
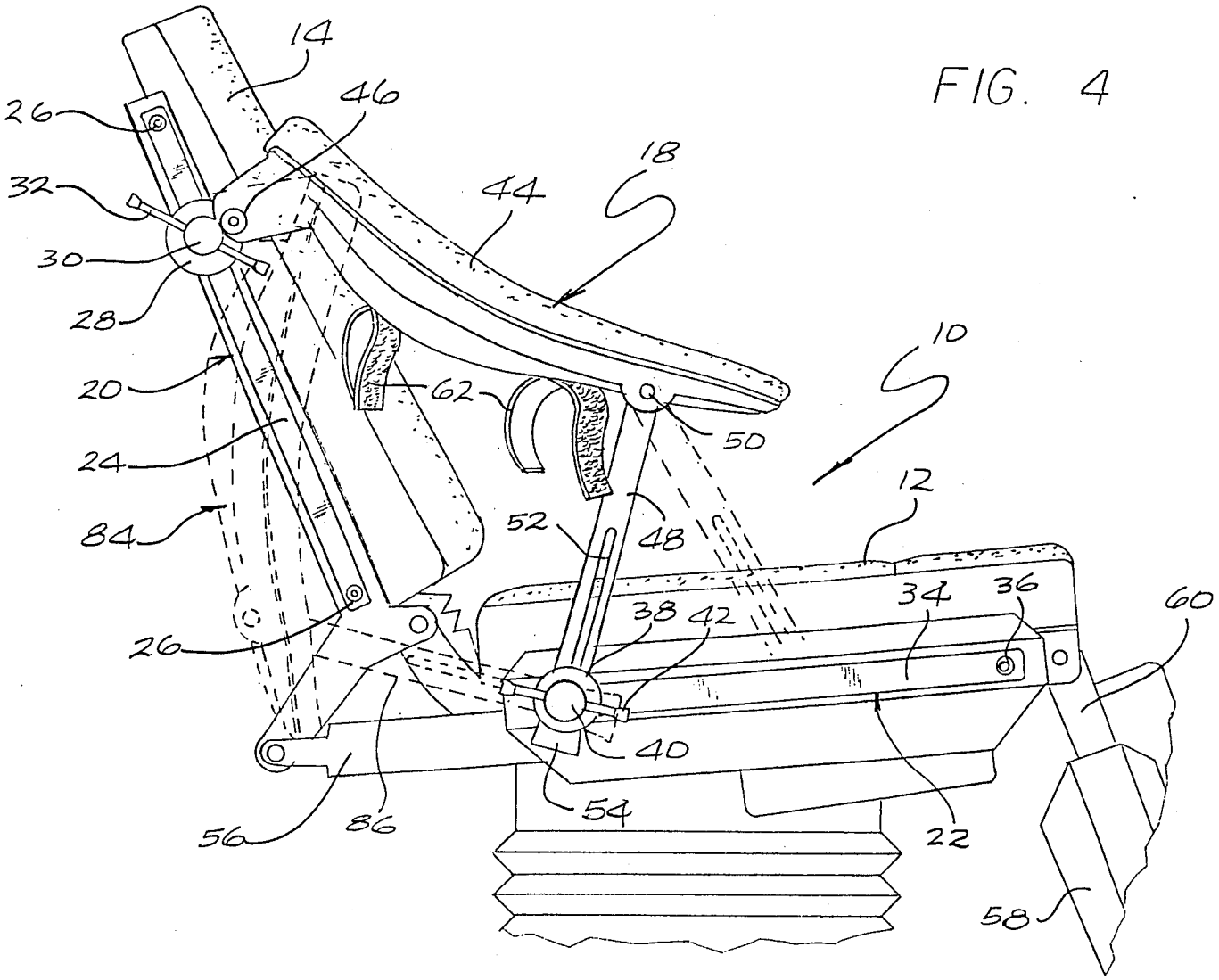
FIG. 4 is a side elevational view, again showing the armrest in various positions with the chair in the upright position.

As can be seen in the various figures, the armrest assembly 18 includes a first slide mechanism 20 attached to the side of the back 14 and a second slide mechanism 22 attached to side of the seat 12. The first slide mechanism includes a rail member formed as a rectangular slide bar 24 supported away from the side of the back 14 by post members 26. This is most clearly illustrated in FIGS. 1 and 2. In FIGS. 3 and 4, the ends of the posts 26 are shown.

A sliding member formed by a cylindrical structure 28 includes a slot to receive the bar 24. The structure 28 is positioned to slide relative to the slide bar 24. A locking member 30 extends along the central axis of the cylindrical structure 28. The locking member 30 is threaded within the cylindrical structure 28 and includes a handle 32 so that the cylindrical structure may be locked at any position along the slide bar 24. In this way, the cylindrical structure 28 may be slid to any position along the length of the slide bar 24 and locked in this position by turning the handle 32.

The slide mechanism 22 has a similar structure including a rail member formed as a rectangular slide bar 34 supported away from the side of the seat 12 by posts 36. Again, this may be most clearly seen in FIGS. 1 and 2. A cylindrical structure 38 forming a slide member similarly includes a slot to receive and slide along the slide bar 34 so that the cylindrical structure may be adjusted along the length of the slide bar 34. A locking member 40 extends along the central axis of the cylindrical structure and is controlled by a handle 42 to lock the cylindrical structure 38 in any position along the length of the slide bar 34.

An arm member 44, which may be padded is pivotably attached at a rear attachment portion to the cylindrical structure 28 by pivot connection 46. This is most clearly shown in FIGS. 3 and 4. A pivotably link member 48 is pivot attached at a front attachment portion of the arm member 44 by pivot connection 50. The pivot link 48 extends downward and is attached through a second slot in the cylindrical structure 38. As can be seen in FIGS. 1 and 2, the cylindrical structure 38 is actually formed by a plurality of slotted cylindrical members which are coupled together by locking member 40 so that the cylindrical members can rotate relative to each other and yet allow for the sliding of the cylindrical structure 38 along the slide bar 34 and allow the pivot link 48 to slide up or down through the cylindrical structure 38. The pivot link 48 may include a slot 52 having a closed end 54 to guide the pivot link 48 and yet prevent the pivot link 48 from coming out of engagement with the cylindrical structure 38.

For some uses, it is not necessary to provide a sliding adjustment for the pivot connection 46. Specifically, the cylindrical structure 28 can be fixed in location at an upper position along the chair back as shown in FIGS. 3 and 4 near the shoulder joint. This is typically within the upper one third ($\frac{1}{3}$) position along the chair back. This structure eliminates the slide bar 24 and fixes the cylindrical structure 28 to the side of the chair back 14.

Also illustrated in the present application, is a pivoting structure 56 for allowing the chair back 14 to be adjusted from an upright to a reclining position and this structure is conventional and forms no part of the present invention. Similarly, a footrest 58 having a pivotal connection 60 is also illustrated and again forms no part of the present invention. The arm member 44 may additionally include straps 62 having end portions formed of VELCRO like material so as to be wrapped around the arm of a patient and thereby immobilize the arm when desired.

FIGS. 1 and 2 illustrate the various sliding motions which can be provided by the adjustable armrest of the present invention. As shown in FIG. 1 by the arrow 64, the lower portion of the pivot link 48 as coupled through the cylindrical structure 38 may be slid along the slide bar 64 to adjust its position along the seat of the chair. The pivot link 48 itself may have its length adjusted as shown by the arrow 66. The rear of the arm member 44 as attached to the cylindrical structure 28 may be slid along the side of the chair back as shown by arrow 68. In addition to the sliding motions, the various pivotal motions are shown in FIG. 3. Specifically, as shown by arrow 70, the rear end of the arm member 44 may be rotated about the pivot connection 46. The front end of the arm member 44 may be rotated around pivot connection 50 as shown by arrow 72. Finally, the lower end of the pivot link 48 may be rotated about the cylindrical structure 38 as shown by the arrow 74.

The operation of the present invention may be clearly shown with reference to FIGS. 3 and 4. In FIG. 3, for example, the full line portion shows the arm member 44 having its rear end raised substantially upward and having the pivot link 48 at substantially its maximum length and positioned at a rear position along the slide bar 34. In dotted position 76, the arm member 44 has its rear end lowered as shown at position 78 and has the front end elevated and with the pivot link 48 moved along the slide bar 34 as shown at dotted position 80.

Also as shown in FIG. 3 in dotted position, the seat back 14 may be inclined back and with the arm member shown in the position it would assume if the arm memer were previously in the position as shown in the full line position of FIG. 3. This is shown by the dotted position 82 in FIG. 3. It will be appreciated, of course, that the front end of the arm member 44 could be lowered by either shortening the pivot link 48 or sliding the pivot link along the slide bar 34 and, of course, the rear position of the arm member 44 can be slid along the slide bar 24. In this way, a plurality of adjustments including height, angle and fore and aft position may be adjusted to accommodate any desired position for the adjustable armrest.

FIG. 4 illustrates how the armrest may be swung away to make it easier for a patient to sit or leave the chair. Specifically as shown in FIG. 4 in the dotted position 84, the arm member 44 may be pivoted backward and with the pivot link 48 rotated almost 180° from the full line position so that the pivot link extends not down from the arm, but rather forward from the top surface of the arm member 44. This is shown by the dotted position 86 for the pivot link.

It can be seen, therefore, that the adjustable armrest of the present invention provides for complete adjustability to enhance the use of the armrest for a variety of different situations. The armrest is pivoted at both ends and with its rear end pivoted to a sliding mechanism to adjust the rear end of the armrest along the side of the chair back. The front end of the armrest is coupled to an adjustable length pivot link to a second sliding mechanism along the side of the chair. This simple structure provides for a complete adjustability as to height, angle and fore and aft position for the adjustable armrest of the present invention.

Although the invention has been described with reference to a particular embodiment, it is to be appreciated that various adaptations and modifications may be made and the invention is only to be limited by the appended claims.

I claim:

1. An adjustable armrest for use with a chair having a seat and a reclining back, including a first rail member attached to the side of the chair back, a second rail member attached to the side of the chair seat, a first sliding member coupled to the first rail member for sliding along the first rail member and including first locking means for locking the first sliding member along the first rail member, a second sliding member coupled to the second rail member for sliding along the second rail member and including second locking means for locking the second sliding member along the second rail member, an armrest located adjacent the side of the chair having a front attachment portion and a back attachment portion and having the back attachment portion of the armrest pivotably attached to the first sliding member for rotational movement about the first sliding member, a pivot link having one end pivotable attached to the front attachment portion and the other end pivotably attached to the second sliding member for rotational movement about the second sliding member and armrest and wherein the pivot link is adjustable in length, the first rail member formed by an elongated rectangular bar and attached to the chair back by posts located at the ends of the bar, the second rail member formed by an elongated rectangular bar and attached to the chair seat by posts located at the ends of the bar, the first sliding member formed as a cylindrical structure having a central axis perpendicular to the first rail member and with the first locking means located along the central axis thereof, the second sliding member formed as a cylindrical structure having a central axis perpendicular to the second rail member and with the second locking means located along the central axis thereof and, the adjustable pivot link slidably received by the second sliding member and with the second locking means of the second sliding member locking both the second sliding member along the second rail member and the adjustable pivot link along the second sliding member.

2. The adjustable armrest of claim 1 additionally including at least one strap means attached to the armrest for immobilizing an arm resting on the armrest.

3. The adjustable armrest of claim 2 wherein the strap includes hook and loop fastening means for closing the strap about the arm.

4. An adjustable armrest for use with a chair having a seat and a reclining back, including a rail member attached to the side of the chair seat, a sliding member coupled to the rail member for sliding along the rail member and including locking means for locking the sliding member along the rail member, an armrest located adjacent the side of the chair having a front attachment portion and a back attachment portion and having the back attachment portion of the armrest pivotably attached to the side of the chair back at an upper position for shoulder support and for rotational movement about the side of the chair back, a pivot link having one end pivotable attached to the front attachment portion and the other end pivotably attached to the sliding member for rotational movement about the sliding member and armrest and wherein the pivot link is adjustable in length, the rail member formed by an elongated rectangular bar and attached to the chair back by posts located at the ends of the bar, the sliding member formed as a cylindrical structure having a central axis perpendicular to the rail member and with the locking means located along the central axis, and the adjustable pivot link slidably received by the sliding member and with the locking means of the sliding member locking both the sliding member along the rail member and the adjustable pivot link along the sliding member.

5. The adjustable armrest of claim 4 additionally including at least one strap means attached to the armrest for immobilizing an arm resting on the armrest.

6. The adjustable armrest of claim 5 wherein the strap includes hook and loop fastening means for closing the strap about the arm.

7. The adjustable armrest of claim 4 wherein the back attachment portion of the armrest is pivotably attached to the side of the chair back within an upper one third ($\frac{1}{3}$) position along the length of the chair back.

* * * * *